US005090977A

United States Patent [19]

Strack et al.

[11] Patent Number: 5,090,977

[45] Date of Patent: Feb. 25, 1992

[54] SEQUENCE FOR SEPARATING PROPYLENE FROM CRACKED GASES

[75] Inventors: Robert D. Strack; Rimas V. Vebeliunas; David A. Bamford, all of Houston; Roy T. Halle, Clear Lake, all of Tex.

[73] Assignee: Exxon Chemical Patents Inc., Linden, N.J.

[21] Appl. No.: 613,435

[22] Filed: Nov. 13, 1990

[51] Int. Cl.[5] ..... F25J 3/06

[52] U.S. Cl. ..... 62/23; 62/11; 208/351

[58] Field of Search ..... 62/23, 24, 28, 11; 208/351

[56] References Cited

U.S. PATENT DOCUMENTS

| | | | |
|---|---|---|---|
| 2,952,983 | 9/1960 | Gilmore | 62/24 |
| 3,150,199 | 9/1964 | Greco et al. | 62/23 |
| 3,187,064 | 6/1965 | Wang et al. | 62/23 |
| 3,675,435 | 7/1972 | Jackson et al. | 62/23 |
| 3,849,096 | 11/1974 | Kniel | 208/351 |
| 3,932,156 | 1/1976 | Stern | 62/23 |
| 4,285,708 | 8/1981 | Politte et al. | 62/23 |
| 4,331,461 | 5/1982 | Karbosky et al. | 62/23 |
| 4,411,676 | 10/1983 | Tedder | 62/24 |
| 4,430,102 | 2/1984 | Tedder | 62/24 |
| 4,753,667 | 6/1988 | O'Connell et al. | 62/28 |

*Primary Examiner*—Ronald C. Capossela
*Attorney, Agent, or Firm*—Linda K. Russell

[57] ABSTRACT

A process sequence for treating cracked gases of heavy feedstocks which preferentially produces propylene to the exclusion of propane, butanes and butenes. The process eliminates the need for a depropanizer with the attendant savings in capital and operating costs. In lieu of a conventional C3 splitter, the process features a depropylenizer, i.e. a distillation tower designed to separate propylene from propane, butanes and butenes. A hydrogenation unit to eliminate contaminants can be placed upstream of the depropylenizer or the depropylenizer can be split into two sections with the hydrogenation unit located between the two sections.

21 Claims, 5 Drawing Sheets

SEQUENCE FOR SEPARATING PROPYLENE FROM CRACKED GASES

BACKGROUND OF THE INVENTION

1. Field of the invention

This invention relates to a process sequence for the fractional distillation of light end components such as those which might be produced by steam cracking, catalytic cracking and coking and, more particularly, to a process sequence for separating propylene from a mixture of light end components which eliminates the need for a depropanizer unit.

2. Description of the prior art

Reaction conditions for steam cracking are selected to maximize the production of light olefins. Typically, cracking is practiced at a weight ratio of 0.3:1.0 of steam to hydrocarbon with the reactor coil outlet at 760°-870° C., and slightly above 100 kPa (atmospheric) pressure.

The type of feedstocks and the reaction conditions determine the mix of products produced. Many steam crackers operate on light paraffin feeds consisting of ethane and propane and the like. However, a significant amount of steam cracking capacity operates on feedstocks which contain propane and heavier compounds. Steam cracking such feedstocks tends to produce significant amounts of propylene, propane, butenes, and butadiene. It is in the separation of steam cracked products from these feedstocks that this invention has its application.

During steam cracking, cracked gases emerging from the reactors are rapidly quenched to arrest undesirable secondary reactions which tend to destroy light olefins. The cooled gases are subsequently compressed and separated to recover the various olefins.

The recovery of the various olefin products is usually carried out by fractional distillation using a series of distillation steps to separate out the various components. Generally, one of two basic flow sequences is used. The two sequences are usually denominated as the front-end depropanizer sequence, commonly referred to as 'front-end deprop', or the front-end demethanizer sequence, commonly referred to as 'front-end demeth'.

In either sequence, gases leaving the cracking ovens are quenched, compressed, have their acid gas removed, and are dried. At this point the two flow sequences diverge. In the front-end depropanizer sequence the gases, which contain hydrocarbons having from one to five or more carbon atoms per molecule (C1 to C5+) next enter a depropanizer. The heavy ends exiting the depropanizer consist of C4 to C5+ compounds. These are routed to a debutanizer where the C4's and lighter species are taken over the top with the rest of the feed leaving as bottoms which can be used for gasoline or other chemical recovery. The tops of the depropanizer containing C1 to C3 compounds are fed to an acetylene hydrogenation unit then a demethanizer system where the methane and any remaining hydrogen are removed as an overhead. The heavy ends exiting the demethanizer system which contains C2 and C3 compounds are introduced into a deethanizer wherein C2 compounds are taken off the top and C3 compounds are taken from the bottom. The C2 species are, in turn, fed to a C2 splitter which produces ethylene as the light product and ethane as the heavy product. The C3 stream is fed to a C3 splitter which separates the C3 species, sending propylene to the top and propane to the bottom.

In the front-end demethanizer sequence the quenched, compressed acid-freed and dried gases containing C1 to C5+ compounds first enter a demethanizer system, where C1 and any hydrogen are removed. The heavy ends exiting the demethanizer system consists of C2 to C5+molecules. These are routed to a deethanizer where the C2 species are taken over the top and the C3 to C5+compounds leave as bottoms. The C2 species leaving the top of the deethanizer are fed to an acetylene hydrogenation or recovery unit, then to a C2 splitter which produces ethylene as the light product and ethane as the heavy product. The C3 to C5+stream leaving the bottom of the deethanizer is routed to a depropanizer which sends the C3 compounds overhead and the C4 to C5+components below. The C3 product is fed to a C3 hydrogenation unit to hydrogenate C3 acetylenes and dienes, then to a C3 splitter where it is separated into propylene at the top and propane at the bottom, while the C4 to C5+stream is fed to a debutanizer which produces C4 compounds at the top with the balance leaving the bottoms to be used for gasoline.

A considerable amount of work has been done on improving the basic process of separating the products of steam cracking. Much of the work on light ends fractionation has been concerned with the improvement of the various components of the process. Other improvements relate to improved computer control of the process. Progress has also been made in the optimum design and operation of the process through the use of improved physical property correlations. Although there have been improvements in the sophistication of the design of fractionation steps such as two-tower demethanizers, deethanizers, and depropanizers, heat-pumped towers, and improved separation efficiencies through the use of dephlegmators, the basic flow sequences as outlined above have remained essentially unchanged.

A shortcoming of the presently known flow sequences is that they invariably feature a depropanizer which serves to split the C3 and lighter compounds from the C4 and heavier compounds. In some situations, depending on the market values of the various products and on the particular circumstances of the processing facilities, it may be unnecessary and wasteful to separate the C3 and lighter fraction from the C4 fraction. Specifically, where the relative value of propylene is sufficiently high and the C4 value is low and/or available separation facilities so dictate, it would be more profitable to produce propylene in preference to a complete slate of products.

It would thus be desirable to have a flow sequence capable of preferentially producing propylene using less separation equipment.

SUMMARY OF THE INVENTION

This invention successfully addresses the need for a process flow sequence for a simplified fractional distillation sequence capable of producing propylene by providing a flow sequence which eliminates the need for a depropanizer and which is capable of preferentially producing high quality propylene.

This invention discloses a novel flow sequence for the production of propylene from steam cracked gases which is simpler than conventional sequences in that it eliminates the need for a depropanizer. The flow sequence of this invention is a modified version of the front-end demethanizer sequence described above.

As in the front-end demethanizer sequence the cracked gases leaving the cracking furnace are quenched in a quench vessel. The quenched gases are then compressed and undergo acid gas removal and drying. The gases containing C1 to C5+species then enter a demethanizer system, where methane and any hydrogen are removed. The heavy ends exiting the demethanizer system consists of C2 to C5+compounds. These are routed to a deethanizer where the C2 species are taken over the top and the C3 to C5+compounds leave as bottoms. The C2 species leaving the top of the deethanizer may be fed to a C2 splitter to produce ethylene as the light product and ethane as the heavy product.

The C3 to C5+stream leaving the bottom of the deethanizer is routed to a debutanizer which sends the C3 and C4 to the overhead to leave the heavier components as bottoms which can be used for gasoline. The C3/C4 overhead product is fed to a splitter designed to separate the C3/C4 into propylene at the top and propane and C4 compounds at the bottom. This splitter resembles a C3 splitter, but produces C4 in the bottoms in addition to propane, while sending the propylene to the top. This implies that a higher level heat than that normally required for conventional C3 splitters will be required in order to reboil the C4 molecules. For purposes of this application, this splitter will be termed a "depropylenizer".

The bottoms product of the depropylenizer which contains propane and C4's can be recycled back to the cracking furnace where it undergoes cracking to form a series of products which include propylene or used as is as a C3/C4 product. The newly formed propylene is removed during the next pass through the depropylenizer. Thus, the bottoms of the depropylenizer serve to recycle to extinction the C4 and propane to be cracked to propylene.

The process of this invention thus serves to produce methane, hydrogen, ethane, ethylene, C5+, and, of course, propylene. No propane, butane, butene, or butadiene is produced. The flow sequence of this invention completely eliminates the need for a depropanizer with the attendant reduction in capital and operating expenses.

In one embodiment of this invention the depropylenizer is split into two sections with a hydrogenation unit inserted between the two sections. In another embodiment a hydrogenation unit is interposed upstream of the depropylenizer for the purpose of removing contaminants which may act to foul the processing equipment.

BRIEF DESCRIPTION OF THE DRAWINGS

The above and other embodiments of the present invention may be more fully understood from the following detailed description, when taken together with the accompanying drawing wherein similar reference characters refer to similar elements throughout, and in which.

DESCRIPTION OF THE PREFERRED EMBODIMENTS

The present invention of a processing sequence for the treatment of cracked gases can be used to obtain a propylene product without also separating propane and C4 compounds and without the need for a depropanizer. Specifically, this invention can be used to significantly simplify the sequence for the treatment of cracked gases where it is economically and/or operationally desirable to preferentially produce propylene and where it is not desired to also produce propane and C4 compounds.

Figure 1:
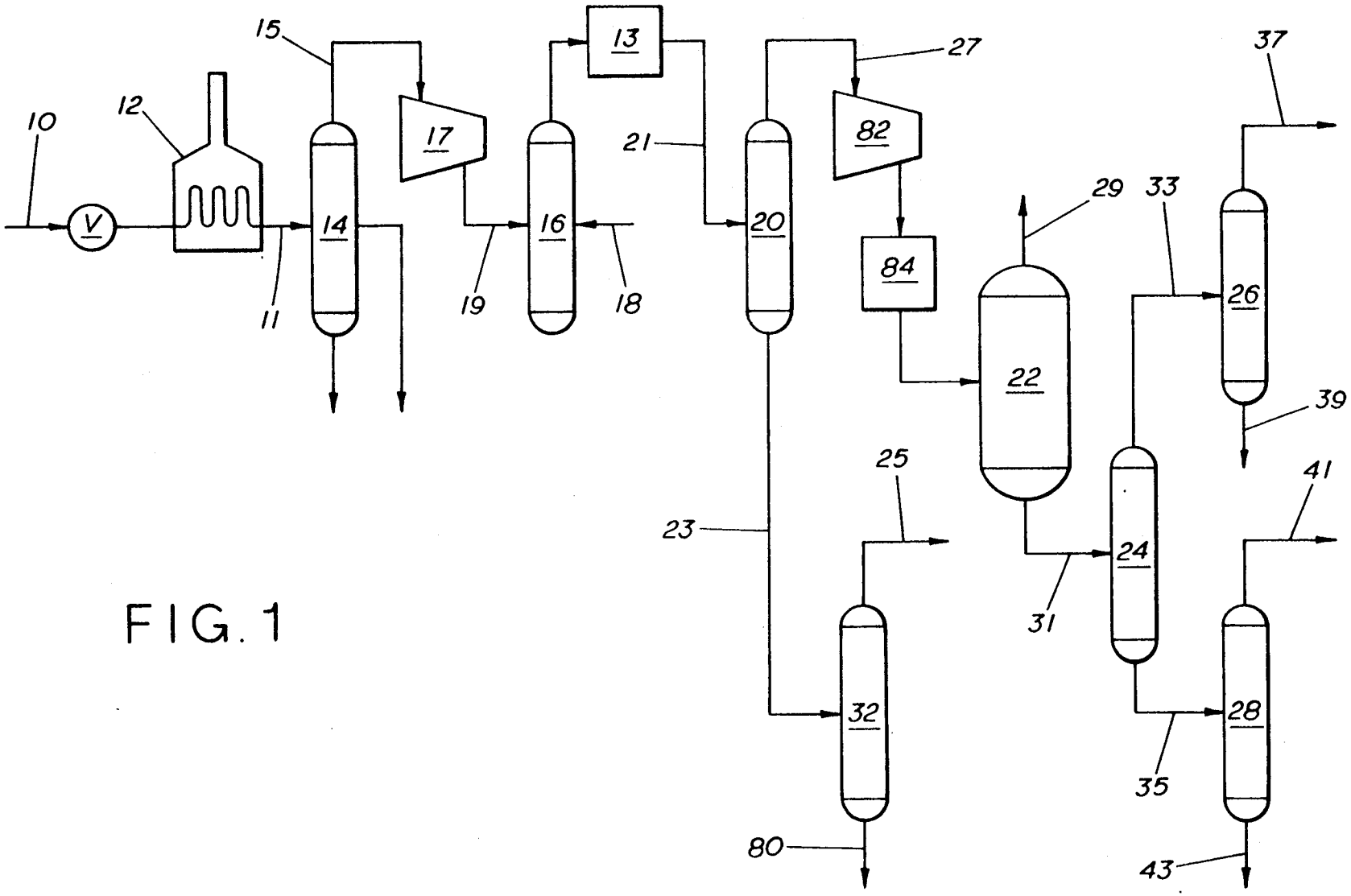
FIG. 1 is a flow diagram of the conventional front-end depropanizer process for the separation of steam cracked gases.
Figure 2:
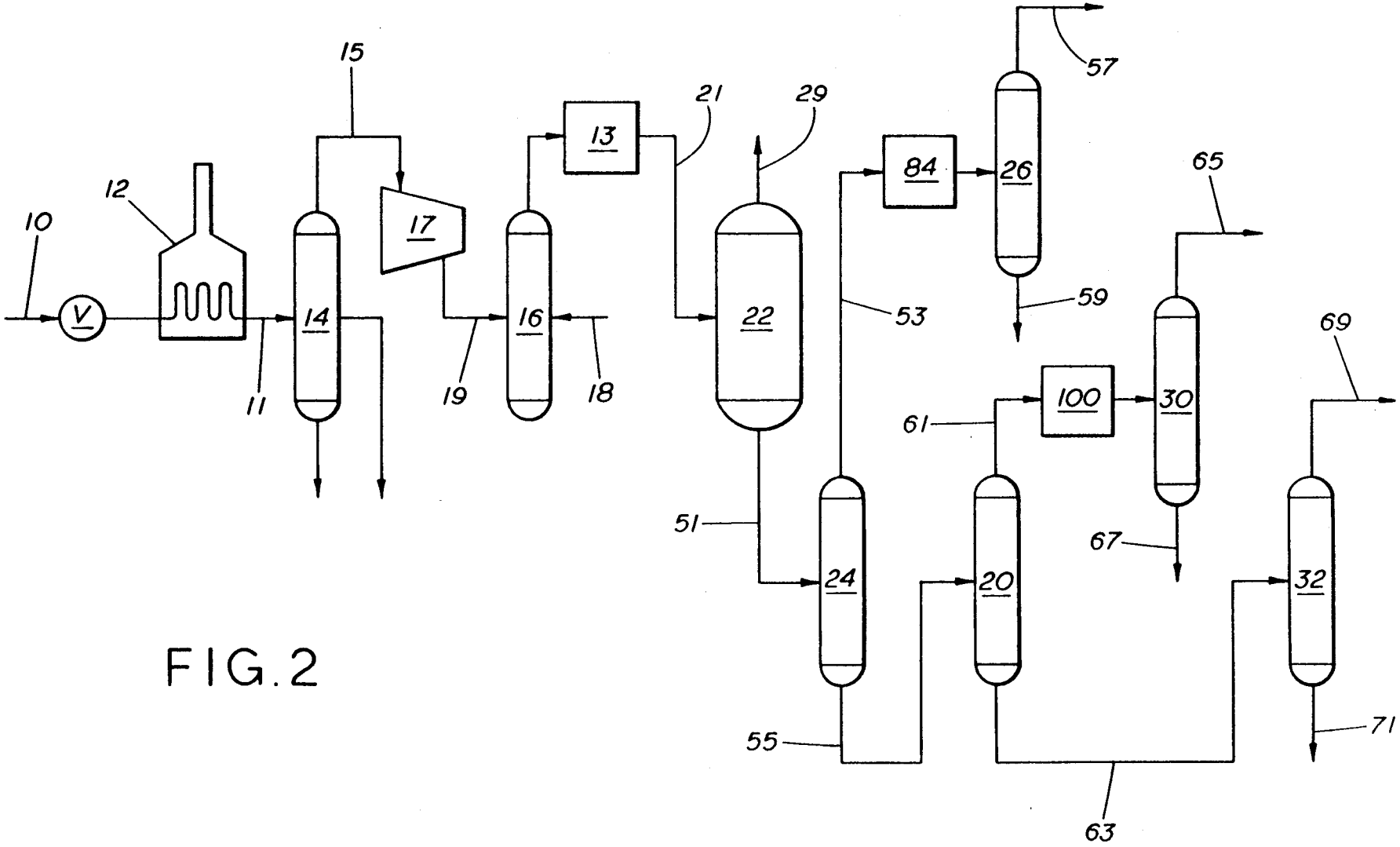
FIG. 2 is a flow diagram of the conventional front-end demethanizer process for the separation of steam cracked gases.

With reference to FIGS. 1 and 2, there are currently two main process sequences for the separation of light ends steam cracked gases. Under either sequence, feed 10 consisting of a mixture of ethane, propane and butanes, naphtha or gas oil, or various combinations of this feed, is introduced into a cracking oven 12 where the feed 10 is cracked to form a mixture of products. The cracked gases 11 leaving the cracking oven 12 are quenched in a quench vessel 14 to arrest undesirable secondary reactions which tend to destroy light olefins. The quenched gases 15 are then compressed in a compressor 17. The compressed gases are fed to an acid gas removal vessel 16 where they undergo acid gas removal, typically with the addition of a base such as NaOH 18. The gases are dried in a dehydration system 13. At this point the gases 21 contain hydrocarbons having from one to five and more carbon atoms per molecule (C1 to C5+).

It is at this point that the two commonly encountered flow sequences for the separation of cracked gases diverge. Referring now to the drawing, FIG. 1 shows a flow diagram of the front-end depropanizer flow sequence. The gases 21 leaving the dehydration system 13 first enter a depropanizer 20. The heavy ends 23 exiting the depropanizer consist of C4 to C5+compounds. These are routed to a debutanizer 32 where the C4 species are taken over the top 25 with the balance leaving as bottoms 80 which can be used for gasoline or other chemical recovery. The tops 27 of the depropanizer 20 containing C1 to C3 compounds are further compressed in compressor 82, fed to an acetylene hydrogenation or recovery unit 84, and then fed to a demethanizer system 22 where the methane and remaining hydrogen 29 are removed. The heavy ends 31 exiting the demethanizer system 22 which contain C2 and C3 compounds are introduced into a deethanizer 24 wherein C2 are taken off the top 33 and C3 species are taken from the bottom 35. The C2 species 33 are, in turn, fed to a C2 splitter 26 which produces ethylene 37 as the light product and ethane 39 as the heavy product. The C3 stream 35 is fed to a C3 splitter 28 which separates the C3 sending propylene 41 to the top and propane 43 to the bottom.

In the other basic flow sequence for the treatment of cracked gases, commonly known as the front-end demethanizer sequence, and shown in FIG. 2, the quenched and acid free gases containing C1 to C5+compounds first enter a prechill and demethanizer system 22, where methane and hydrogen 29 are removed. The heavy ends 51 exiting the demethanizer system 22 consist of C2 to C5+. These are routed to a deethanizer 24 where the C2 species are taken over the top 53 and the C3 to C5+compounds leave as bottoms 55. The C2 species leaving the top of the deethanizer are fed to an acetylene hydrogenation or recovery unit 84, and then fed to a C2 splitter 26 which produces ethylene 57 as the light product and ethane 59 as the heavy product. The C3 to C5+stream 55 leaving the bottom of the deethanizer 24 is routed to a depropanizer 20 which sends the C3 species overhead 61 and the C4 to C5+species below 63. The C3 product 61 may be fed to a methyl acetylene and propadiene hydrogenation unit then to a C3 splitter 30 to separate the C3 stream into propylene 65 at the top and propane 67 at the bottom, while the C4 to C5+stream 63 is fed to a debutanizer 32 which produces C4 species at the top 69 with the C5+species leaving the bottoms 71 which can be used for gasoline.

Both of the above conventional sequences produce a methane and hydrogen stream, a C5+and a C4 product, and relatively pure ethane, ethylene, propane, and propylene. It is sometimes not necessary and wasteful to produce separate propane and C4 products. For example, the availability and/or configuration of facilities at a particular site may make it desirable to preferentially produce propylene rather than propane and C4. Similarly, it may be desirable to preferentially produce propylene so as to take advantage of a greater demand and higher equivalent prices for that product relative to propane and the C4 compounds.

The present invention discloses and claims a process sequence which can be used in those situations where it is for whatever reason desirable to preferentially produce propylene and not separate propane and C4 products. The present invention discloses a novel flow sequence for the preferential production of propylene from steam cracked gases, which process is somewhat less complicated than either of the two conventional sequences described above in that the process sequence of the present invention eliminates the need for a depropanizer.

Figure 3:
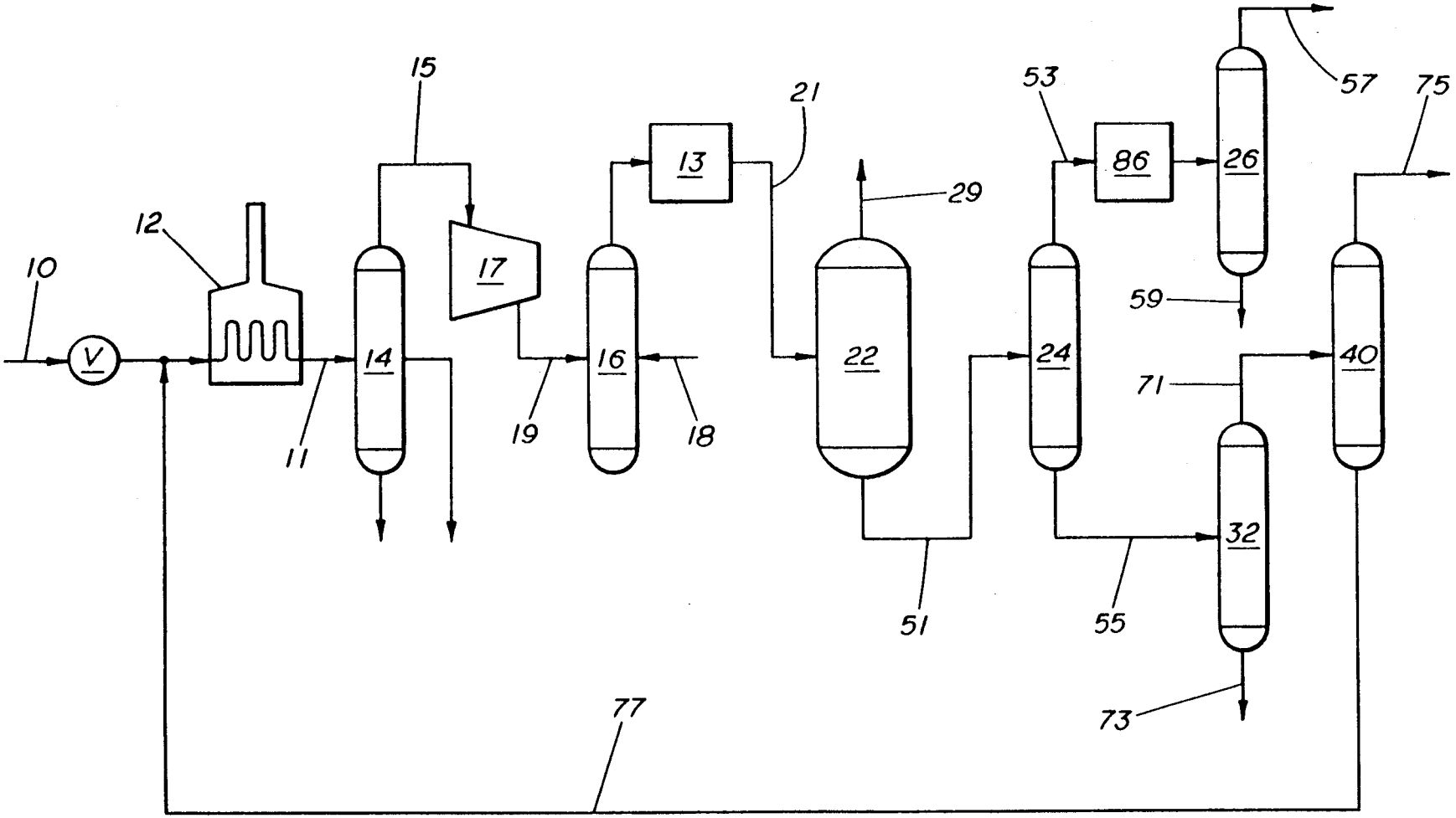
FIG. 3 is a flow diagram of the basic process for the separation of steam cracked gases of the present invention.

The basic flow sequence can be appreciated with reference to FIG. 3. The flow sequence of this invention is a modified version of the front-end demethanizer sequence described above. As in the front-end demethanizer sequence the feed 10 is fed to the cracking furnace 12 and cracked gases 11 are quenched, compressed and undergo acid gas removal and drying. The gases 21 containing C1 to C5+first enter a prechill and demethanizer system 22, where methane and any hydrogen 29 are removed. The heavy ends 51 exiting the demethanizer system consist of C2 to C5+. These are routed to a deethanizer 24 where the C2 species are taken over the top 53 and the C3 to C5+leave as bottoms 55. Acetylene is hydrogenated or removed from the C2 leaving the top of the deethanizer 53 in unit 86 and the remaining C2 stream is fed to a C2 splitter 26 to produce ethylene 57 as the light product and ethane 59 as the heavy product.

The C3 to C5+stream leaving the bottom of the deethanizer 55 is next routed to a debutanizer 32. The debutanizer 32 serves to separate the feed, sending the C3 and C4 compounds overhead 71 and sending the heavier components below 73 to gasoline or other chemical recovery. The debutanizer 32 may be constructed of two chambers (not shown), a rectifying chamber at high pressure and a second chamber operating at a lower pressure. Splitting the debutanizer in such a way may positively impact the energy efficiency of the separation and may reduce the fouling normally encountered. The C3/C4 overhead product 71 is fed to a splitter 40 designed to separate the C3/C4 into propylene 75 at the top and propane and C4 at the bottom 77. This splitter resembles a C3 splitter in that it serves to separate propylene from propane. Unlike conventional C3 splitters, which are fed mixtures consisting of only propylene and propane, this splitter 40 is fed C4 in addition to the C3 and thus produces C4 components in the bottoms 77 together with propane. For purposes of this application, this splitter 40 will be termed a "depropylenizer".

The bottoms product 77 of the depropylenizer 40 which contains propane and C4 can be recycled back to the cracking furnace 12 where it undergoes cracking to form a series of products which include propylene. The newly formed propylene is removed during the next pass through the depropylenizer 40. Thus, the bottoms 77 of the depropylenizer serve to recycle to extinction the C4 and propane to be cracked to propylene. Alternatively, the bottoms can be sent to fuel or alternative disposition.

The process of this invention thus serves to produce a methane and hydrogen product, ethane, ethylene, C5+, and, propylene. No propane, or C4 compounds are produced. The flow sequence of this invention completely eliminates the need for a depropanizer, included the associated condenser, reboiler and other equipment, with the attendant reduction in capital and operating expenses.

Figure 4:
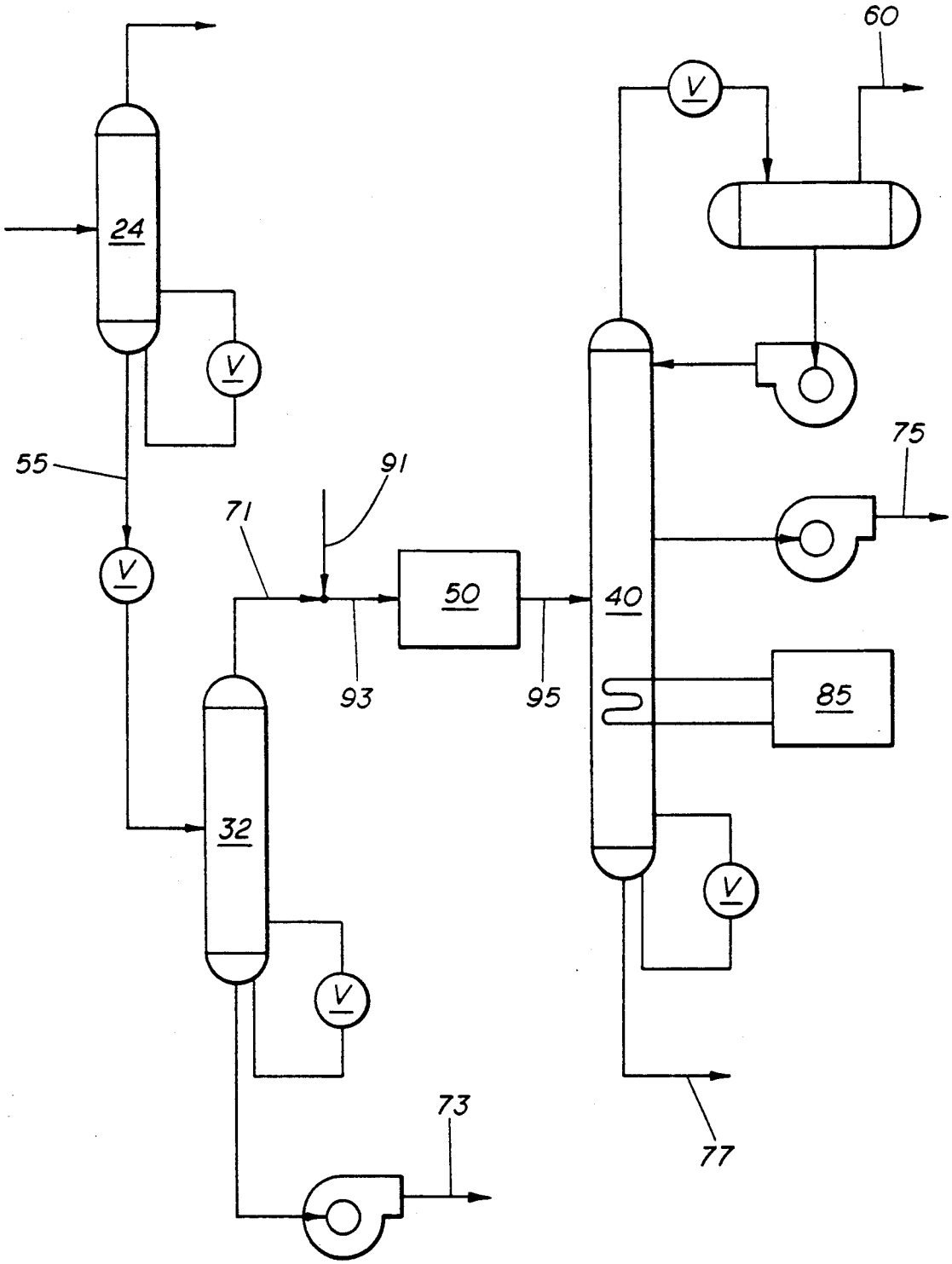
FIG. 4 is a flow diagram of a portion of the process for the separation of steam cracked gases of the present invention featuring an in-line hydrogenation unit upstream of the depropylenizer.

Many refinements and adjustments may be made on the basic process flow sequence of the present invention. Several such refinements are shown in FIG. 4. Depicted is the back-end portion of the process of the present invention starting with the deethanizer 24. The C2 splitter and all equipment upstream of the deethanizer 24 have been omitted from the diagram for clarity.

The deethanizer 24 operates in such a fashion as to produce a bottom product 55 which is essentially free of ethane and ethylene. Typically, the ethane and ethylene concentration of the bottoms 55 from the deethanizer 24 should be under 1000 ppm, preferably under 750 ppm, to meet typical propylene product specifications. Under certain circumstances it may be appropriate to produce a bottoms 55 of higher ethane and ethylene concentrations.

The C3 to C5+stream leaving the bottom 55 of the deethanizer 24, which is essentially free of C2, is fed to a debutanizer 32, which sends the C3 and C4 component overhead 71 and the heavier components below 73 as pyrolysis gasoline, or pygas, which can be used for gasoline.

The C3/C4 overhead product 71 may contain small amounts of compounds which, if allowed to remain in the system, would tend to foul the depropylenizer 40 and the downstream heat exchange surfaces. In addition, such contaminants could concentrate in the depropylenizer and lead to hazardous operating conditions in the form of increased explosion risks. These undesirable compounds include primarily methyl acetylene, propadiene and higher molecular weight diolefins and acetylenes.

To react these undesirable compounds and reduce them to levels where fouling is not a serious problem and the explosion hazard is reduced, hydrogen 91 is added to the C3/C4 overhead stream 71 from the debutanizer 32 and the combined gases 93 are fed to a hydrogenation unit 50. In the hydrogenation unit 50, the various contaminants are hydrogenated to form propylene, propane, butylenes, and butane.

The hydrogenated C3/C4 stream 95 is then fed to a depropylenizer 40 designed to separate the C3/C4 components into propylene at the top 75 and propane and C4 species at the bottom 77. The depropylenizer 40 may be equipped with a pasteurization section at its top to eliminate any light ends 60 which may remain at this point in the process because of upstream upsets, excess hydrogen required by the hydrogenation unit 50, and light impurities (e.g. methane) in the hydrogen, and ensure that the propylene product 75 produced is of sufficiently high purity so as to be readily marketable. If a pasteurization section is used, the propylene product leaves the column via a side stream draw off 75.

The depropylenizer 40 may be equipped with a side reboiler 85 to improve heat efficiency.

The bottoms product 77 of the depropylenizer 40, containing propane and C4 compounds can be recycled to the cracking furnace 12 where the molecules undergo cracking to form a series of products which include propylene, which is subsequently separated as saleable product. Alternatively, the bottoms can be sent to fuel or alternative disposition.

Figure 5:
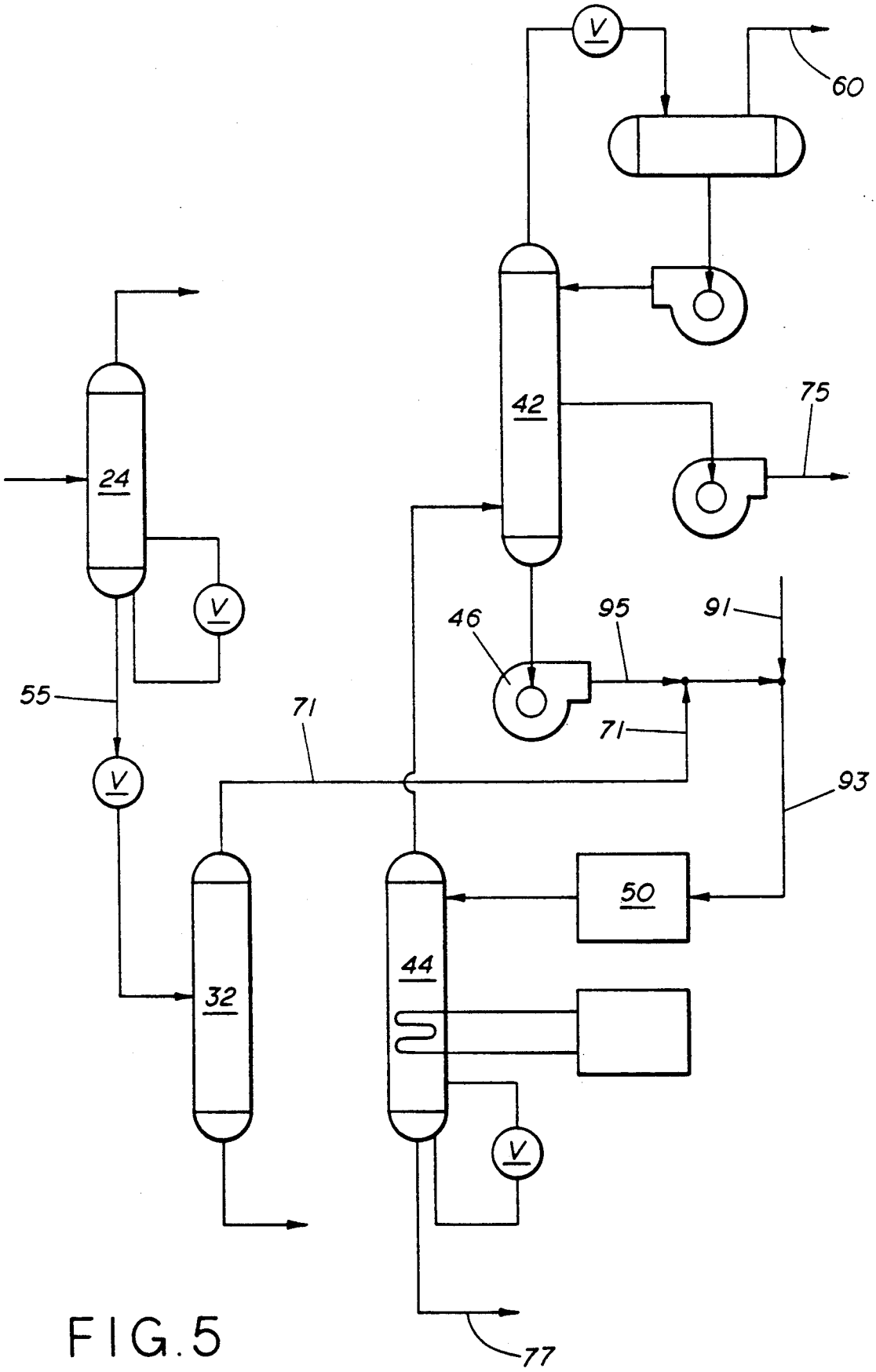
FIG. 5 is a flow diagram of a portion of the process for the separation of steam cracked gases of the present invention featuring a split depropylenizer and intermediate hydrogenation unit.

A further refinement to the basic process flow sequence is shown in FIG. 5, which resembles the previous figure, except for the configuration of the depropylenizer and the placement of the hydrogenation unit.

To maximize hydrogenation unit efficiency and longevity, it is best to feed the hydrogenation unit a stream having a concentration of diolefins and other undesirable components which is as dilute as possible. The main reasons for this are that high concentrations will be detrimental to the hydrogenation unit selectivity and will generate very high heats of reaction. For this reason, a fraction of the output stream from a hydrogenation unit is often recycled back and combined with the fresh feed to the hydrogenation unit. In addition, it is sometimes important to ensure that feed to a liquid phase hydrogenation unit is completely liquid. Both of these requirements can be fulfilled in the sequence of FIG. 5 and are accomplished without need to directly recycle the hydrogenation unit output stream.

The depropylenizer, because of the small difference in boiling points of propylene and propane, and because of the generally high propylene purity requirements, typically 99.5%, would, if constructed as a single unit, be an extremely tall distillation column. What is typically done is to split the depropylenizer into a top section 42 and a bottom section 44 and provide a large transfer pump 46 to transfer liquid from the bottom of the top section 42 to the top of the bottom section 44.

In the sequence shown in FIG. 5 the hydrogenation unit 50 is located between the two sections and is fed by a liquid stream which is a combination of the condensed overhead product 71 of the debutanizer 32, the liquid depropylenizer flow 95 from the transfer pump 46, and an appropriate amount of hydrogen 91. Due to the nature of the separation, the depropylenizer typically has a large reflux. Thus, the flow entering the hydrogenation unit 50 can be very large, ensuring that the acetylene concentration will be acceptably low without the need for the recycling of the hydrogenation unit output stream, thus controlling the reaction temperature. In this arrangement, the heat of hydrogenation serves to supplement the reboiler heat input to the tower, potentially saving energy.

This concludes the description of preferred embodiments of applicant's invention. Those skilled in the art may find many variations and adaptations thereof, and all such variations and adaptations, falling within the true scope and spirit of applicant's invention, are intended to be covered thereby.

EXAMPLE

The flow sequence of the present invention was studied using computer simulation. The configuration shown in FIG. 4 was used, except that a dual pressure debutanizer was used instead of the single debutanizer of FIG. 4. Table 1 displays the conditions and composition of several of the key streams featured in FIG. 4.

TABLE 1

| STREAM→ | 55 | 71 | 95 | 60 | 75 | 77 |
|---|---|---|---|---|---|---|
| TEMP (C.) | 71.000 | 11.452 | 50.000 | 79.000 | 10.000 | 75.000 |
| PRESS (kPa) | 700.000 | 2200.000 | 2099.999 | 1800.000 | 1800.000 | 1800.000 |
| MOLE FRACTION VAPORIZED | 0.93543 | 0.0 | 0.0 | 1.00000 | 0.0 | 0.0 |
| COMPOSITION | | | | | | |
| H2 | 0.0 | 0.0 | 0.00025 | 0.03349 | 0.00000 | 0.0 |
| METHANE | 0.0 | 0.0 | 0.00013 | 0.01594 | 0.00001 | 0.0 |
| ETHYLENE | 0.0 | 0.0 | 0.0 | 0.00025 | 0.0 | 0.0 |
| ETHANE | 0.03483 | 0.04110 | 0.04100 | 4.28119 | 0.01830 | 0.0 |
| ACETYLENE | 0.0 | 0.0 | 0.0 | 0.0 | 0.0 | 0.0 |
| PROPYLENE | 40.87390 | 48.23483 | 50.43436 | 95.43211 | 99.62999 | 0.38686 |
| PROPANE | 7.50269 | 8.85308 | 8.83092 | 0.23702 | 0.35171 | 17.46956 |
| PROPADIENE | 1.08721 | 1.28297 | 0.93167 | 0.0 | 0.0 | 1.88086 |
| METHYLACETYLNE | 1.85028 | 2.18338 | 0.10890 | 0.0 | 0.0 | 0.21982 |
| ISOBUTANE | 2.29033 | 2.70249 | 2.69572 | 0.0 | 0.0 | 5.44159 |
| ISOBUTYLENE | 4.59297 | 5.41960 | 5.40604 | 0.0 | 0.0 | 10.91262 |
| 1-BUTENE | 2.59694 | 3.08441 | 4.90670 | 0.0 | 0.0 | 9.90465 |
| BUTADIENE | 13.76385 | 16.23958 | 14.79444 | 0.0 | 0.0 | 29.86401 |
| BUTANE | 5.34413 | 6.30559 | 6.28982 | 0.0 | 0.0 | 12.89662 |
| CIS-2-BUTENE | 0.80713 | 0.95216 | 1.21185 | 0.0 | 0.0 | 2.44624 |
| TRANS-2-BUTENE | 0.98649 | 1.16384 | 1.48178 | 0.0 | 0.0 | 2.99111 |
| 3-BUTENE-1-YNE | 0.63927 | 0.75382 | 0.00211 | 0.0 | 0.0 | 0.00425 |
| ETHYLACETYLENE | 0.21309 | 0.25111 | 0.00070 | 0.0 | 0.0 | 0.00142 |
| 1-PENTENE | 0.15331 | 0.17372 | 0.17329 | 0.0 | 0.0 | 0.34980 |

TABLE 1-continued

| | | | | | | |
|---|---|---|---|---|---|---|
| ISOPRENE | 0.35773 | 0.35659 | 0.35570 | 0.0 | 0.0 | 0.71802 |
| CYCLOPENTADIENE | 1.29694 | 1.07947 | 1.07676 | 0.0 | 0.0 | 2.17355 |
| CIS-1,3-PENTADIENE | 0.68986 | 0.52806 | 0.52674 | 0.0 | 0.0 | 1.06327 |
| METHYLCYCLOPENTADIENE | 0.29127 | 0.02813 | 0.02806 | 0.0 | 0.0 | 0.05664 |
| BENZENE | 10.22523 | 0.38611 | 0.38515 | 0.0 | 0.0 | 0.77746 |
| TOLUENE | 1.49623 | 0.0 | 0.0 | 0.0 | 0.0 | 0.0 |
| STYRENE | 0.94435 | 0.0 | 0.0 | 0.0 | 0.0 | 0.0 |
| VINYLTOLUENE | 0.55802 | 0.0 | 0.0 | 0.0 | 0.0 | 0.0 |
| INDENE | 0.06132 | 0.0 | 0.0 | 0.0 | 0.0 | 0.0 |
| DICYCLOPENTADIENE | 0.11344 | 0.0 | 0.0 | 0.0 | 0.0 | 0.0 |
| NAPHTHALENE | 1.22948 | 0.0 | 0.0 | 0.0 | 0.0 | 0.0 |
| GREEN OIL | 0.0 | 0.0 | 0.31803 | 0.0 | 0.0 | 0.64198 |

What is claimed is:

1. A process for separating propylene from a mixture of cracked hydrocarbons produced by a cracking unit, comprising the steps of:

(a) separating the mixture in a deethanizer into a deethanizer tops stream and deethanizer bottoms stream;

(b) separating the deethanizer bottoms stream in a debutanizer into a debutanizer tops stream and a debutanizer bottoms stream;

(c) separating the debutanizer tops stream in a depropylenizer into a depropylenizer tops stream comprising propylene and a depropylenizer bottoms stream.

2. A process as in claim 1, further comprising: separating the deethanizer tops stream into an ethane stream and an ethylene stream.

3. A process as in claim 1, further comprising: recycling the depropylenizer bottoms stream to the cracking unit.

4. A process as in claim 1, wherein the depropylenizer is made up of a top section and a bottom section with liquid flow means for conducting liquid from the bottom of the top section to the top of the bottom section and vapor flow means for conducting vapor from the top of the bottom section to the bottom of the top section.

5. A process as in claim 4, further comprising:

separating the deethanizer tops stream into an ethane stream and an ethylene stream.

6. A process as in claim 4, further comprising:

recycling the depropylenizer bottoms stream to the cracking unit.

7. A process as in claim 4, wherein the said liquid flow means includes a hydrogenation unit.

8. A process for separating propylene from a mixture of cracked hydrocarbons produced by a cracking unit, comprising the steps of:

(a) separating the mixture in a deethanizer into a deethanizer tops stream and deethanizer bottoms stream;

(b) separating the deethanizer bottoms stream in a debutanizer into a debutanizer tops stream and a debutanizer bottoms stream;

(c) treating the debutanizer tops stream in a hydrogenation unit to produce a hydrogenation unit outlet stream;

(d) separating the hydrogenation unit outlet stream in a depropylenizer into a depropylenizer tops stream comprising propylene and a depropylenizer bottoms stream.

9. A process as in claim 8, further comprising:

separating the deethanizer tops stream into an ethane stream and an ethylene stream.

10. A process as in claim 8 wherein the depropylenizer is provided with a pasteurization section capable of removing unreacted hydrogen and light components.

11. A process as in claim 8, further comprising: recycling the depropylenizer bottoms stream to the cracking unit.

12. A process for separating propylene from a mixture of cracked hydrocarbons produced by a cracking unit, comprising the steps of:

(a) separating the mixture in a demethanizer system into a demethanizer tops stream and demethanizer bottoms stream;

(b) separating the demethanizer bottoms stream in a deethanizer into a deethanizer tops stream and deethanizer bottoms stream;

(c) separating the deethanizer bottoms stream in a debutanizer into a debutanizer tops stream and a debutanizer bottoms stream;

(d) separating the debutanizer tops stream in a depropylenizer into a depropylenizer tops stream comprising propylene and a depropylenizer bottoms stream.

13. A process as in claim 12, further comprising: separating the deethanizer tops stream into an ethane stream and an ethylene stream.

14. A process as in claim 12, further comprising: recycling the depropylenizer bottoms stream to the cracking unit.

15. A process as in claim 12, wherein the depropylenizer is made up of a top section and a bottom section with liquid flow means for conducting liquid from the bottom of the top section to the top of the bottom section and vapor flow means for conducting vapor from the top of the bottom section to the bottom of the top section.

16. A process as in claim 15, further comprising: separating the deethanizer tops stream into an ethane stream and an ethylene stream.

17. A process as in claim 15, further comprising: recycling the depropylenizer bottoms stream to the cracking unit.

18. A process as in claim 15, wherein said liquid flow means includes a hydrogenation unit.

19. A process for separating propylene from a mixture of cracked hydrocarbons produced by a cracking unit, comprising the steps of:

(a) separating the mixture in a demethanizer system into a demethanizer tops stream and demethanizer bottoms stream;

(b) separating the demethanizer bottoms stream in a deethanizer into a deethanizer tops stream and deethanizer bottoms stream;

(c) separating the deethanizer bottoms stream in a debutanizer into a debutanizer tops stream and a debutanizer bottoms stream;

(d) treating the debutanizer tops stream in a hydrogenation unit to produce a hydrogenation unit outlet stream;

(e) separating the hydrogenation unit outlet stream in a depropylenizer into a depropylenizer tops stream comprising propylene and a depropylenizer bottoms stream.

20. A process as in claim 19, further comprising: separating the deethanizer tops stream into an ethane stream and an ethylene stream.

21. A process as in claim 19, further comprising: recycling the depropylenizer bottoms stream to the cracking unit.

* * * * *